United States Patent [19]

Koller et al.

[11] 4,055,392

[45] Oct. 25, 1977

[54] PROCESS FOR DYEING BLENDED FABRICS

[75] Inventors: Stefan Koller, Ramlinsburg; Marielise Pacher, Munchenstein; Karl Emmenegger, Pratteln, all of Switzerland

[73] Assignee: Ciba-Geigy Corporation, Ardsley, N.Y.

[21] Appl. No.: 571,344

[22] Filed: Apr. 24, 1975

[30] Foreign Application Priority Data

Apr. 29, 1974 Switzerland ..... 5871/74

[51] Int. Cl.[2] ..... D06P 3/82

[52] U.S. Cl. ..... 8/21 C; 8/39; 8/41 C; 8/54; 8/62; 8/71

[58] Field of Search ..... 8/21 C, 41 C, 62

[56] References Cited

FOREIGN PATENT DOCUMENTS

| | | | |
|---|---|---|---|
| 626,764 | 2/1963 | Belgium | 8/21 C |
| 1,257,954 | 2/1961 | France | 8/21 C |
| 1,137,418 | 10/1962 | Germany | 8/21 C |
| 41,311 | 3/1966 | Japan | 8/21 C |
| 6,918,592 | 6/1970 | Netherlands | 8/167 |

*Primary Examiner*—William F. Hamrock

*Attorney, Agent, or Firm*—Karl F. Jorda; Edward McC. Roberts; Prabodh I. Almaula

[57] ABSTRACT

A process for dyeing and printing blends of wool and polyester fibers which comprises the use of dyes of the formula wherein A is the radical of a monofunctional or polyfunctional tertiary amine, X is an anion and F is the radical of a dye of the disperse class. The process yields tone-in-tone dyeings.

12 Claims, No Drawings

PROCESS FOR DYEING BLENDED FABRICS

The invention provides a process for dyeing and printing blended fabrics in tone-in-tone shades with a homogeneous dyestuff class.

The dyeing and printing of textile flat surface structures of fibre blends belonging to different classes is gaining increasing importance. Blends of polyester fibres with wool are preeminent in this respect.

Blended fabrics of wool and polyester fibres are nowadays dyed with dyestuff mixtures with acid or metal complex dyes being used for the wool and the conventional disperse dyes for the polyester, i.e. two classes of dye which are poorly compatible. Wool dyes are normally dissolved warm. In a treatment of this kind, the dispersions of disperse dyes break readily, especially in the presence of the electrolytes in the wool dye, and this results in useless dyeings. To obtain a homogeneous shade on both substrates (which is necessary for a level dyeing of the blended fabric), it is necessary to use complicated dyestuff mixtures even for simple shades, since a single disperse dye almost never has exactly the shade of a specific wool dye. In addition, dyestuff mixtures can only be adjusted to a very specific mixture ratio of polyester/wool. If this ratio changes, differences in the depth of shade on both substrates result.

It is the object of the invention to provide a process for the tone-in-tone dyeing and printing of blends of wool and polyester fibres which comprises the use of dyes of the formula

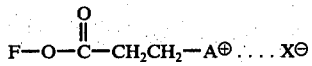

wherein A is the radical of a monofunctional or polyfunctional tertiary amine, X is an anion and F is the radical of a dye of the disperse class.

Such dyes are known, for example, from German Auslegeschrift No. 1 137 418, wherein it is disclosed that the dyes can be used for dyeing polyester fibres through being converted into a disperse dye according to the equation.

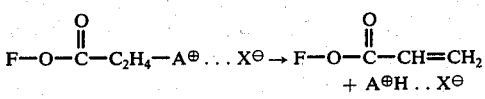

It is surprising, however, that the same cationic dyes are also suitable for providing tone-in-tone dyeings on wool/polyester blends, especially since disperse dyes at most strain wool and cationic dyes also do not yield any satisfactory result on wool.

Examples of suitable azo dyes for carrying out the dyeing process are those of the formulae

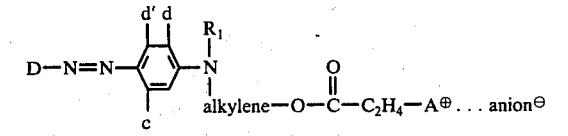

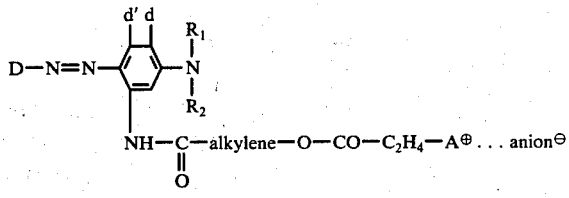

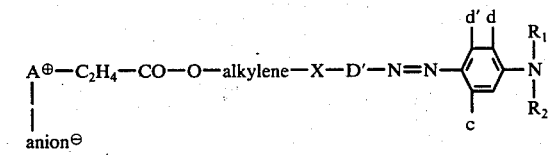

or

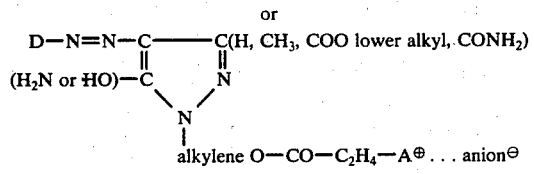

wherein D is the radical of a diazo component of the disperse class, D′ is a phenylene radical which may contain non-ionic substituents, *c* and *d* are hydrogen, lower alkyl, lower alkoxy, chlorine or bromine, *c* is additionally acylamino, above all lower alkylcarbonylamino, *d′* is hydrogen or lower alkylcarbonylamino, each of $R_1$ and $R_2$ is an unsubstituted or a substituted lower alkyl radical, for example benzyl, phenethyl, cyanoethyl, cyanoethoxyethyl, lower alkoxy-lower alkyl, hydroxy-lower alkyl, (lower alkyl- or aryl)-carbonylamino-lower alkyl, lower alkylcarbonyloxy-lower alkyl, benzoyloxy, lower alkyl, lower alkylcarbonylamino-lower alkyl or lower alkylaminocarbonyloxy-lower alkyl, in which connection and hereinafter the term "lower" denotes a carbon content of 1 to 4 carbon atoms. X is a radical of the formulae $—SO_2—$, $—SO_2NH—$, $—NHSO_2—$, —O—, —S—, —CO—O—, —O—CO— or —O—CO—NH—.

Useful pyrazolone or aminopyrazole dyes are those of the formula

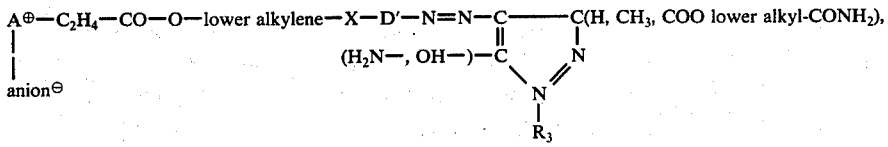

wherein D′ is a phenylene radical which may contain nonionic substituents, X is a radical of the formulae $—SO_2—$, $—SO_2NH—$, —O—, —S—, —CO—O, —O—CO— or —O—CO—NH— and A is the radical of a monofunctional or polyfunctional tertiary amine the one amino group of which is quaternised and is attached to the dyestuff molecule, the "alkylene" radical contains not more than 5 carbon atoms and $R_3$ is an alkyl, aryl, a cyclohexyl or heterocyclic radical which may contain non-ionogenic substituents.

Suitable anthraquinone dyes are primarily those of the formula

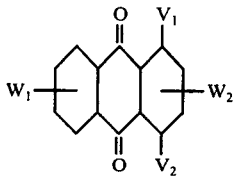

wherein $V_1$ is an optionally lower alkylated amino group or a hydroxy group, $V_2$ is an alkylated or arylated amino group in which the alkyl or aryl moiety carries a group of the formula —O—CO—$CH_2CH_2A$, $W_1$ is a hydrogen atom, a bromine atom, a chlorine atom or a nitro group and $W_2$ is a group of the formula —$W_3$—$W_4$, wherein $W_3$ is a direct bond, an oxygen or a sulphur atom or a —NH group and $W_4$ is an aromatic or an aliphatic radical.

The radicals A are derived from mono- or polyamines that one amino group of which is quaternised and is attached to the dyestuff molecule.

Suitable radicals $A^+$ are those of the formulae

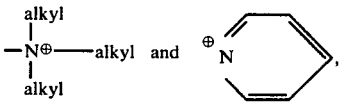

above all tris-lower alkylammonium radicals, such as the trimethylammonium radical, and also the pyrimidinium radical, as well as the radicals of the formulae

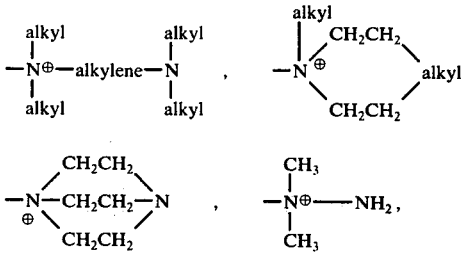

wherein the alkyl radicals can carry substituents, for example phenylcarbonyl or alkoxycarbonyl groups, and preferably contain not more than 8, desirably not more than 4, carbon atoms. The alkylene radical normally contains at most 6 carbon atoms; the ethylene radical is preferred. The radicals A which contain two nitrogen atoms are introduced for example by reaction of equimolar amounts of diamine with the $\beta$-bromopropionic ester of the dye.

As it is known that dyes containing nitro groups do not yield shades which are very fast to light on wool, it is advantageous to use according to the invention dyes which do not contain nitro groups.

The textile materials of wool and aromatic polyesters to be dyed can be in any desired form, for example yarns or wovens. The polyester content can vary from 5 to 95%, although the ordinary commercial mixtures containing 30, 45 and 70% are preferred. Examples of suitable aromatic polyesters are those of terephthalic acid and ethylene glycol or 1,4-dimethylolcyclohexane and copolymers of terephthalic acid and isophthalic acid.

The dyeing is performed at 80° to 120° C, preferably at 90° to 108° C. If the dyeing is carried out at temperatures higher than 108° C, it is necessary to add protective agents for wool, i.e. for example compounds which effect a crosslinking action on the wool. Protective agents for wool are, for example, compounds which liberate formaldehyde under the dyeing conditions. In addition, the customary carriers used in the dyeing of polyester fibres, for example phenylphenols, polychlorobenzene compounds etc., must be present. In this connection it can be of advantage to use those carriers which can be removed by a subsequent heat treatment, i.e. carriers of relatively high volatility, for example trichlorobenzene. Volatile carriers are preferred at temperatures below- 200° C.

It is also advantageous to add levelling agents such as are used for dyeing wool, for example adducts of ethylene oxide and octyl phenol, castor oil, higher alcohols (e.g. $C_{16}H_{33}OH$), dodecyl thiol, polyamines or higher fatty amines (e.g. $C_{12}H_{22}NH_2$ or $C_{18}H_{37}NH_2$).

The dyeing is carried out at pH values of 3 to 8, but preferably of 4 to 6.

The dyeings obtained according to the present process can be subjected to an aftertreatment, for example by heating with an aqueous solution of a non-ionic detergent.

The dyes used according to the invention can also be applied to the polyester/wool blends by printing, wherein the customary printing assistants, provided they contain no acid groups, especially for example wetting agents and thickeners, are used in addition to the assistants mentioned hereinbefore.

Useful additives are aminoplast precondensates, which are used for example for the aftertreatment of dyeings on wool.

In the context of the invention, aminoplast precondensates are to be understood as meaning aqueous solutions of condensates e.g. of urea, thiourea, glyoxal diurein, dicyandiamide, guanamine or melamine with formaldehyde which contain free methylol groups or methylol ether groups, so that they are able to condense further to form cross-linked sinoluble condensates. Urea or melamine/formaldehyde condensates are especially suitable. The methylol groups are desirably etherified with lower alcohols, for example methanol, ethanol or butanol, in order to increase the storability.

The following Examples illustrate the invention, the parts and percentages being by weight unless otherwise indicated.

EXAMPLE 1

0.4 part of the dye of the formula

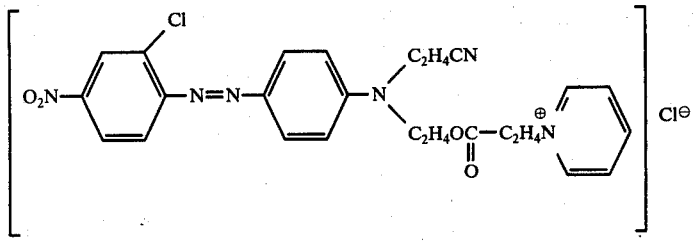

is dissolved together with 2 parts of sodium acetate in 1 liter of water. To this dyebath are added 3 parts of a swelling agent consisting of trichloro-benzene and diphenyl. The pH is adjusted to 5 with acetic acid. 50 parts of a polyester/wool blended fabric (55:45) are put into the bath at 60° C. The bath is heated for 30 minutes to 100° C and dyeing is performed for 2 hours at this temperature. The dyeing is subsequently rinsed, washed at 70° C in an acetic acid bath with an emulsifier, rinsed once more and dried. The swelling agent is removed by thermofixing for 60 seconds at 190° C.

A very level, yellowish red dyeing is obtained on the blended fabric and the wool and polyester contents are dyed absolutely alike in shade. The dyeing is of excellent fastness to washing, water, perspiration, rubbing and sublimation.

EXAMPLE 2

0.5 part of the dye of the formula

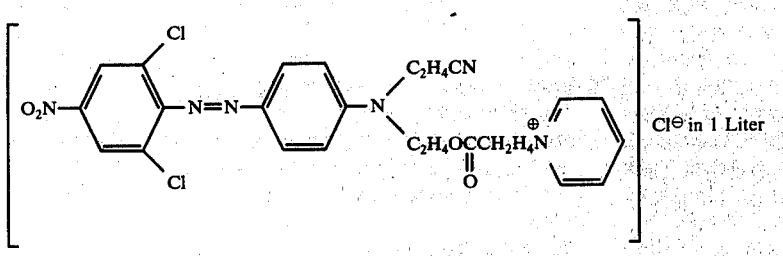

is dissolved in 1 liter of water and 3 parts of the swelling agent used in Example 1 and 0.5 part of a mixture consisting of the ammonium salt of the acid sulphuric acid ester of a reaction product of a fatty amine ($C_{18}$–$C_{22}$) and 30 moles of ethylene oxide and the reaction product of a fatty acid amine ($C_{18}$–$C_{22}$) and 20 moles of ethylene oxide which is quaternised with dimethyl sulphate are added.

The pH is adjusted to 5.5 and 50 parts of a polyester wool blended fabric are put at 60° C into this dyebath. The bath is heated to 106° C and dyeing is performed for 60 minutes at this temperature. The dyeing is subsequently finished as described in Example 1.

A level, brown dyeing of good fastness to washing, water, perspiration, rubbing and sublimation is obtained on the blended fabric. Both fibre components are dyed in exactly the same shade.

EXAMPLE 3

0.5 part of the dye of the formula

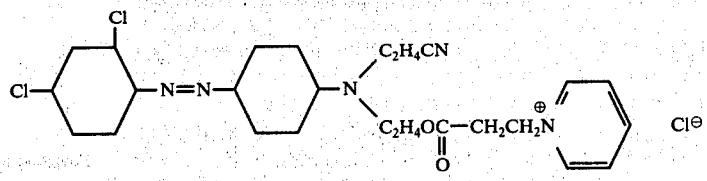

is dissolved in 1000 parts of water at 50° C and 2 parts of sodium acetate as well as 0.25 part of the levelling agent used in Example 2 are added. To this dyebath are added 3 parts of the swelling agent of Example 1 and 3 parts of formaldehyde (30%). A pH of 5 is established with 80% acetic acid. 50 parts of a polyester/wool blended fabric (55/45) which has been prefixed at 180° C are put into a sealed dyeing apparatus at 60° C and the temperature is raised within 40 minutes to 120° C. Dyeing is carried out for 60 minutes at 120° C. The dyeing is subsequently finished as described in Example 1. A level, yellow tone-in-tone dyeing of good fastness to light, washing, water, perspiration, dry heat and rubbing is obtained.

Similarly good results are obtained by dyeing according to the particulars of Examples 1 and 3 with the dyes listed in the following Table.

| | dye | A | Shade on polyester/wool |
|---|---|---|---|
| 4 | 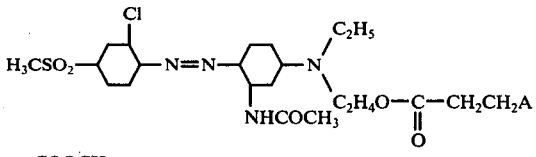 | 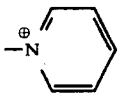 | orange |
| 5 | 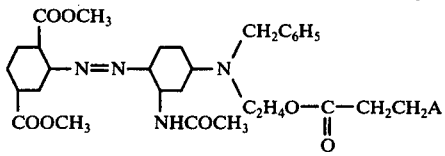 | " | yellowish orange |
| 6 | 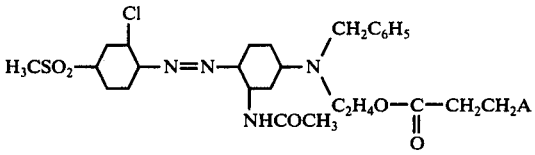 | " | orange |
| 7 | 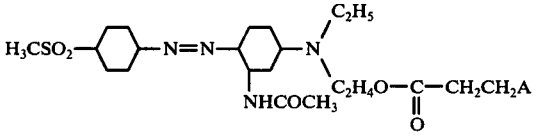 | " | yellowish orange |
| 8 | 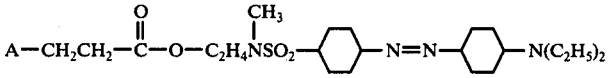 | " | golden yellow |
| 9 | 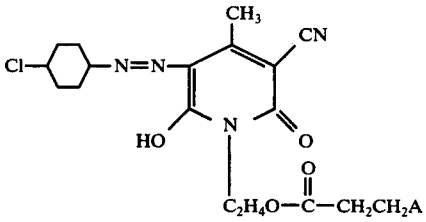 | " | greenish yellow |
| 10 | 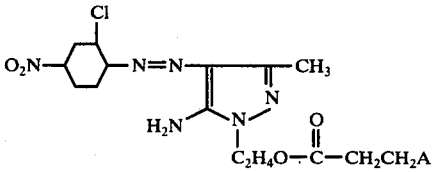 | " | orange |
| 11 | 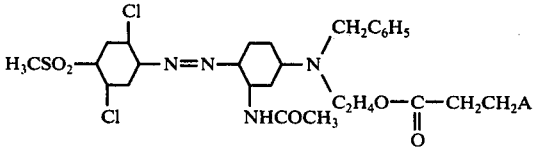 | " | red |
| 12 | 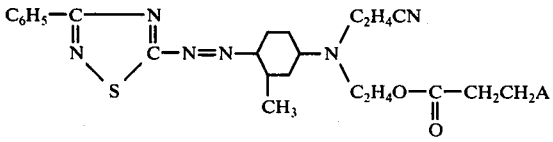 | " | red |
| 13 | 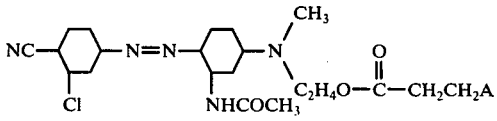 | " | yellowish red |
| 14 | 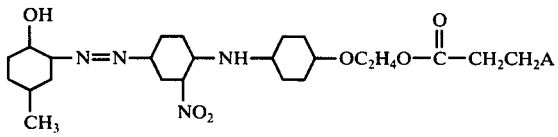 | " | golden yellow |

-continued
| | dye | A | Shade on poly-ester/ wool |
|---|---|---|---|
| 15 | 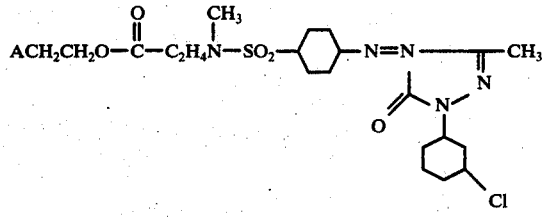 | " | yellow |
| 16 | 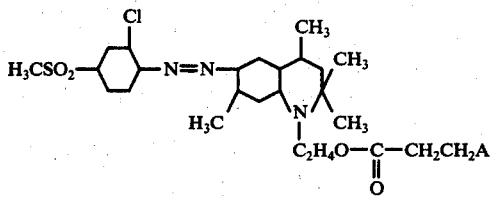 | " | red |
| 17 | 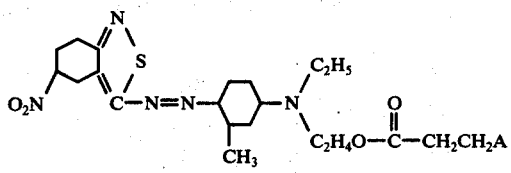 | " | blue |
| 18 | 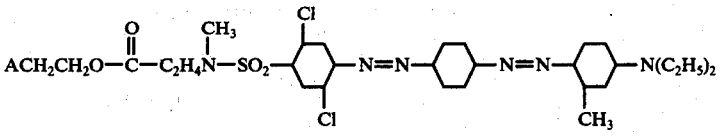 | " | red |
| 19 | 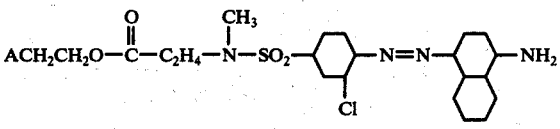 | " | bluish red |
| 20 | 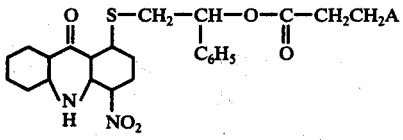 | " | yellow |
| 21 | 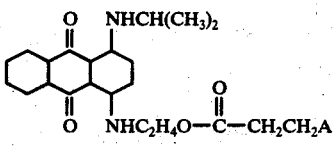 | " | blue |
| 22 | 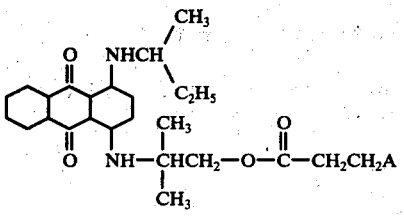 | " | blue |
| 23 | 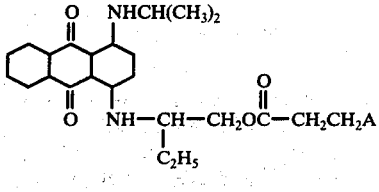 | " | blue |

-continued

| | dye | A | Shade on poly-ester/ wool |
|---|---|---|---|
| 24 | 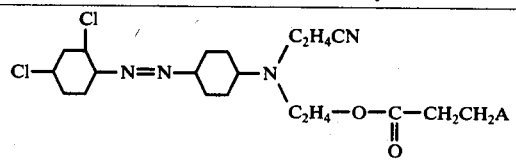 | 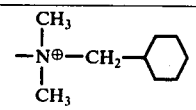 | yellow |
| 25 | " | 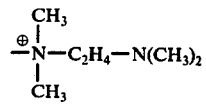 | " |
| 26 | " | 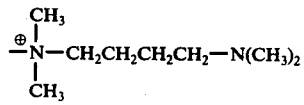 | " |
| 27 | " | 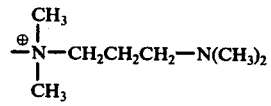 | " |
| 28 | " | 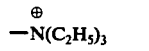 | " |
| 29 | " | 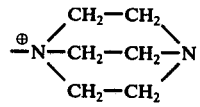 | " |
| 30 | " | 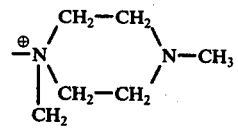 | " |
| 31 | " | 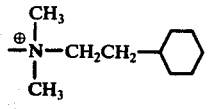 | " |
| 32 | " | 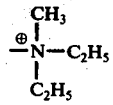 | " |
| 33 | " | 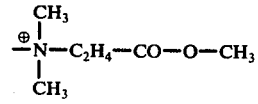 | " |

We claim:

1. A process for dyeing or printing a blend of wool and polyester fibers which comprises the use of a dye of the formula

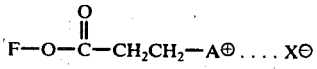

wherein A is selected from the group consisting of

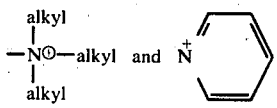

X is an anion and F is a radical of a dye of the disperse class.

2. A process according to claim 1 wherein F is an azo dye radical.

3. A process according to claim 2 which comprises the use of a dye of the formula

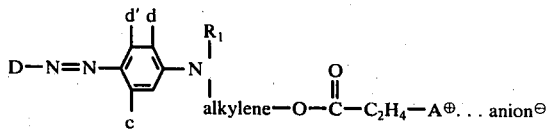

wherein D is the radical of a diazo component of the disperse class, *c* and *d* are hydrogen, lower alkyl, lower alkoxy, chlorine or bromine, *c* is additionally lower alkylcarbonylamino, *d'* is hydrogen or lower alkylcarbonylamino, $R_1$ is an unsubstituted or a substituted alkyl radical.

4. A process according to claim 3, wherein $R_1$ is benzyl, phenethyl, cyanoethyl, cyanoethoxyethyl, lower alkoxy alkyl, hydroxyalkyl, (lower alkyl- or arylcarbonylaminoalkyl), lower alkyl-carbonyloxyalkyl, benzoyloxyalkyl, lower alkylcarbonylaminoalkyl or lower alkylaminocarbonyloxyalkyl.

5. A process according to claim 3 which comprises carrying out the dyeing at 80° to 120° C.

6. A process according to claim 13 which comprises carrying out the dyeing at 90° to 108° C.

7. A process according to claim 3 which comprises the use of carriers which are volatile below 200° C.

8. A process according to claim 3 which comprises adding aminoplast precondensates as retarding agents.

9. A process according to claim 8 which comprises adding urea resin precondensates.

10. A process according to claim 3 which comprises carrying out the dyeing at pH values from 3 to 8.

11. A process according to claim 3 which comprises carrying out the dyeing at pH values of 4 to 6.

12. The blended fabric dyed and printed according to claim 3.

* * * * *

UNITED STATES PATENT AND TRADEMARK OFFICE

CERTIFICATE OF CORRECTION

PATENT NO. : 4,055,392

DATED : October 25, 1977

INVENTOR(S) : STEFAN KOLLER ET AL

It is certified that error appears in the above-identified patent and that said Letters Patent are hereby corrected as shown below:

In Claim 6, column 13, line 13, change "13" to -- 5 --.

Signed and Sealed this

*Seventeenth* Day of *July 1979*

[SEAL]

*Attest:*

*Attesting Officer*

LUTRELLE F. PARKER

*Acting Commissioner of Patents and Trademarks*